US005489658A

United States Patent [19]

Huang

[11] Patent Number: 5,489,658

[45] Date of Patent: Feb. 6, 1996

[54] LIQUID SAUCE CONTAINER PACKET STRUCTURE

[76] Inventor: Tyrone T. Huang, 681, Georgetown Ct., Sunnyvale, Calif. 94087

[21] Appl. No.: 355,021

[22] Filed: Dec. 13, 1994

[51] Int. Cl.[6] ..... B65D 25/38; B65D 35/28; B65D 35/56; B65D 77/38

[52] U.S. Cl. ..... 426/115; 426/112; 426/122; 426/123; 426/411; 206/216; 383/119

[58] Field of Search ..... 426/115, 112, 426/122, 123, 411; 206/216; 383/119

[56] References Cited

U.S. PATENT DOCUMENTS

| | | | |
|---|---|---|---|
| 3,074,544 | 1/1963 | Bollmeier et al. | 206/219 |
| 3,179,320 | 4/1965 | Ward | 206/564 |
| 3,184,319 | 5/1965 | Fritsche | 426/115 |
| 3,442,435 | 5/1969 | Ludder et al. | 220/528 |
| 3,445,050 | 5/1969 | Peters et al. | 220/408 |
| 4,840,271 | 6/1989 | Garwood | 206/213 |
| 4,848,579 | 7/1989 | Barnes et al. | 206/508 |
| 4,889,731 | 12/1989 | Williams, Jr. | 426/106 |
| 5,167,973 | 12/1992 | Snyder | 426/115 |

FOREIGN PATENT DOCUMENTS

| | | |
|---|---|---|
| 482583 | 4/1952 | Canada . |
| 962626 | 2/1975 | Canada . |
| 2623781 | 6/1989 | France . |
| 2673606 | 9/1992 | France . |
| 2242890 | 3/1990 | United Kingdom . |

*Primary Examiner*—Donald E. Czaja
*Assistant Examiner*—Curtis E. Sherrer
*Attorney, Agent, or Firm*—Morton J. Rosenberg; David I. Klein

[57] ABSTRACT

A liquid sauce container packet and tray assembly is provided including a packet (1) containing sauce which is thermally fused on opposing ends to flanges of a tray (2). The thermally fused ends of the packet (1) are formed in a perforated line (3) manner for ease of removal of the packet (1) from the tray (2). Upon separation of the tray (2) and packet (1) along the perforated lines (3), the sauce may be dispensed into the tray (2).

1 Claim, 4 Drawing Sheets

LIQUID SAUCE CONTAINER PACKET STRUCTURE

BACKGROUND OF THE INVENTION

In fast foods restaurants, French fries, fried onion rings and other similar foods are quite popular and the consumer often dips the French fries in catsup or other sauces as a flavor enhancement. The design of conventionally utilized container packets for catsup and other liquid sauces provided to customers often prove difficult to use in that the user does not know the most effective place to dispense the catsup, while some users just place the condiment on a napkin or apply it directly on the food, a practice which is not in keeping with tidiness.

Therefore, the primary objective of the invention herein is to provide a kind of packet container wherein a box-like tray is additionally integrated with the packet container that is easily separated to provide the user with a convenient accessory into which the contained sauce can be poured and thereby achieve the objective of tidiness.

The structural characteristics and functions of the invention herein are elaborated in the attached brief drawings and detailed description.

DETAILED DESCRIPTION OF THE INVENTION

Figure 1:
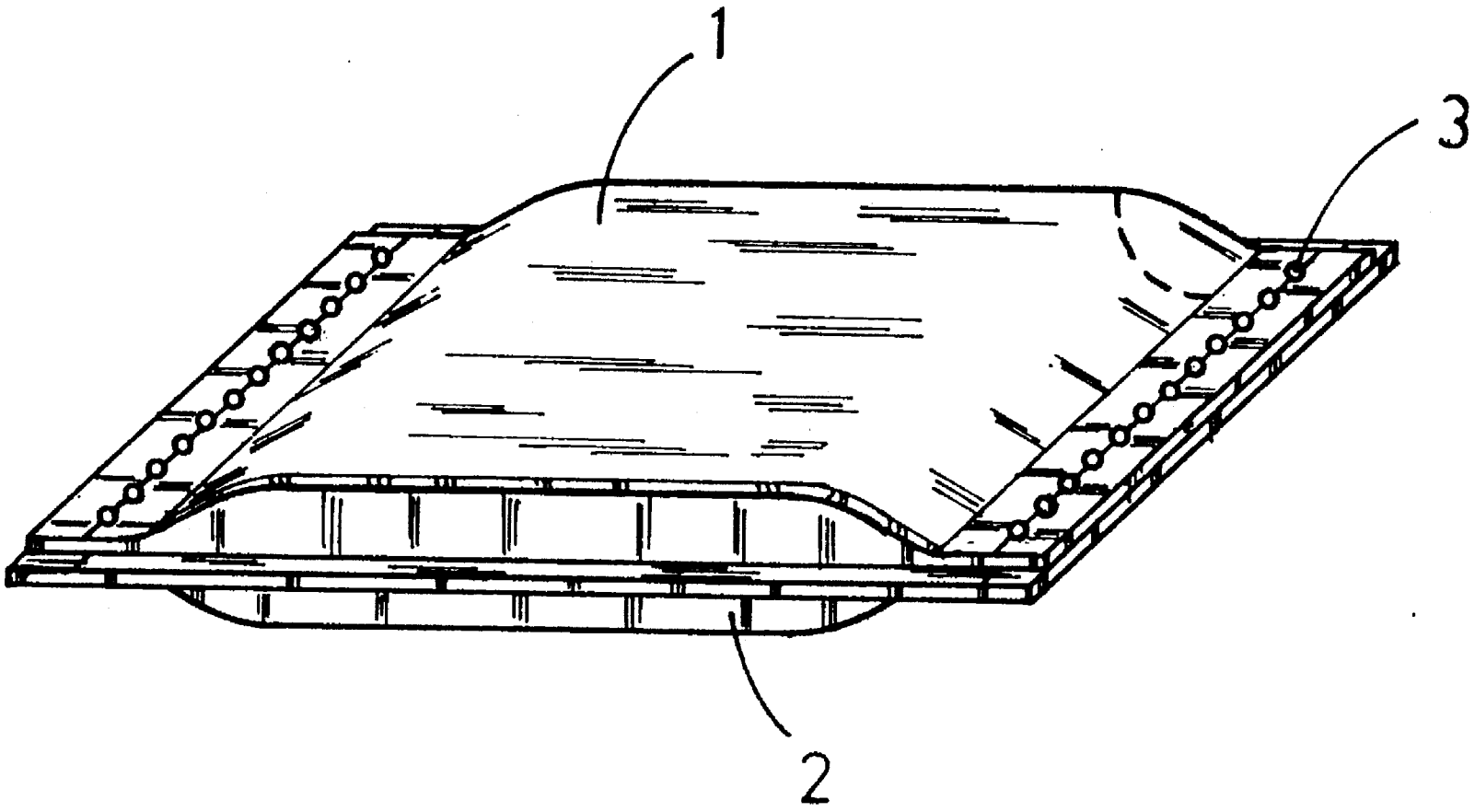
FIG. 1 is an isometric drawing of the invention herein.
Figure 2:
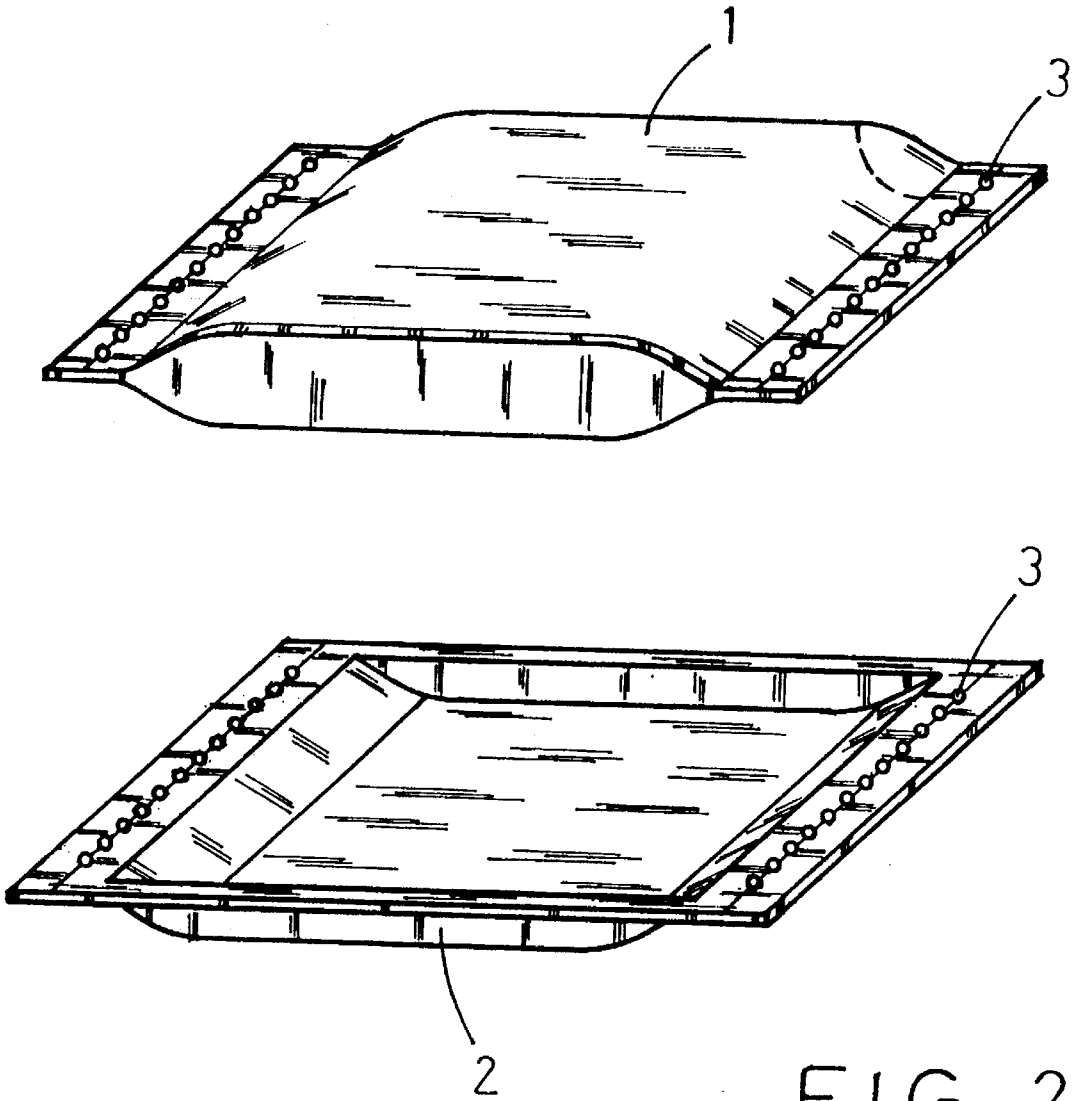
FIG. 2 is an isometric exploded drawing of the invention herein.
Figure 3:
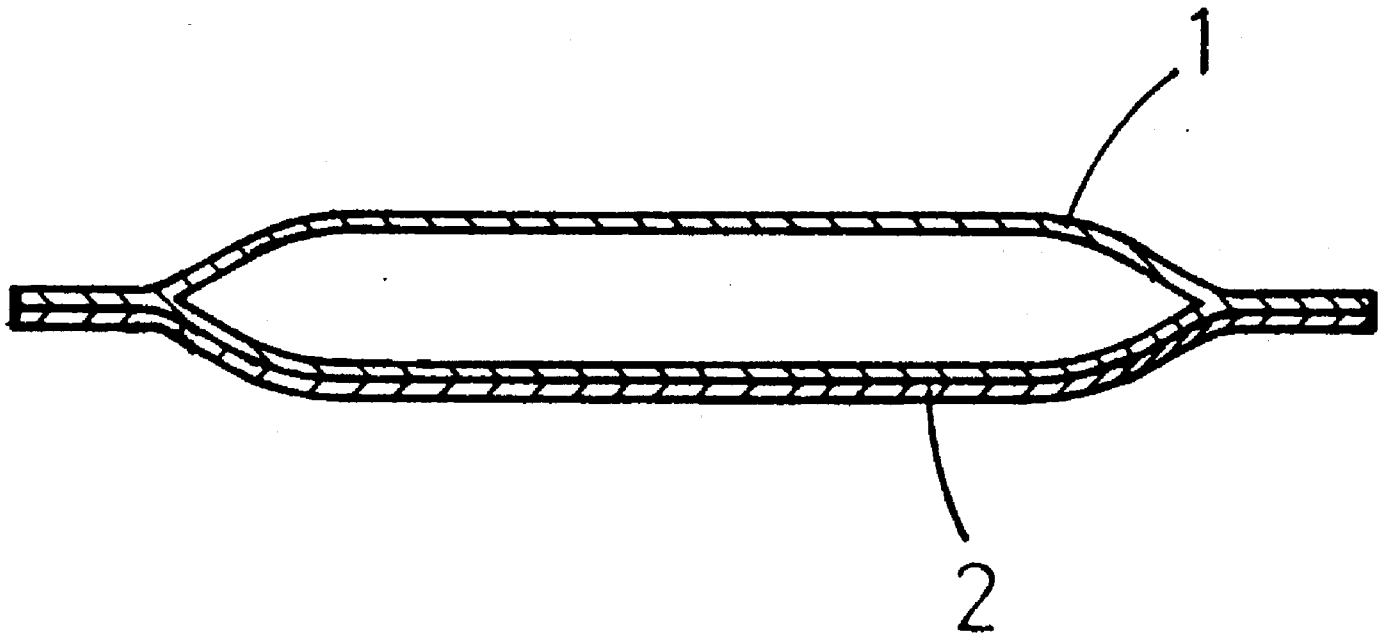
FIG. 3 is a cross-sectional drawing of the invention herein.
Figure 4:
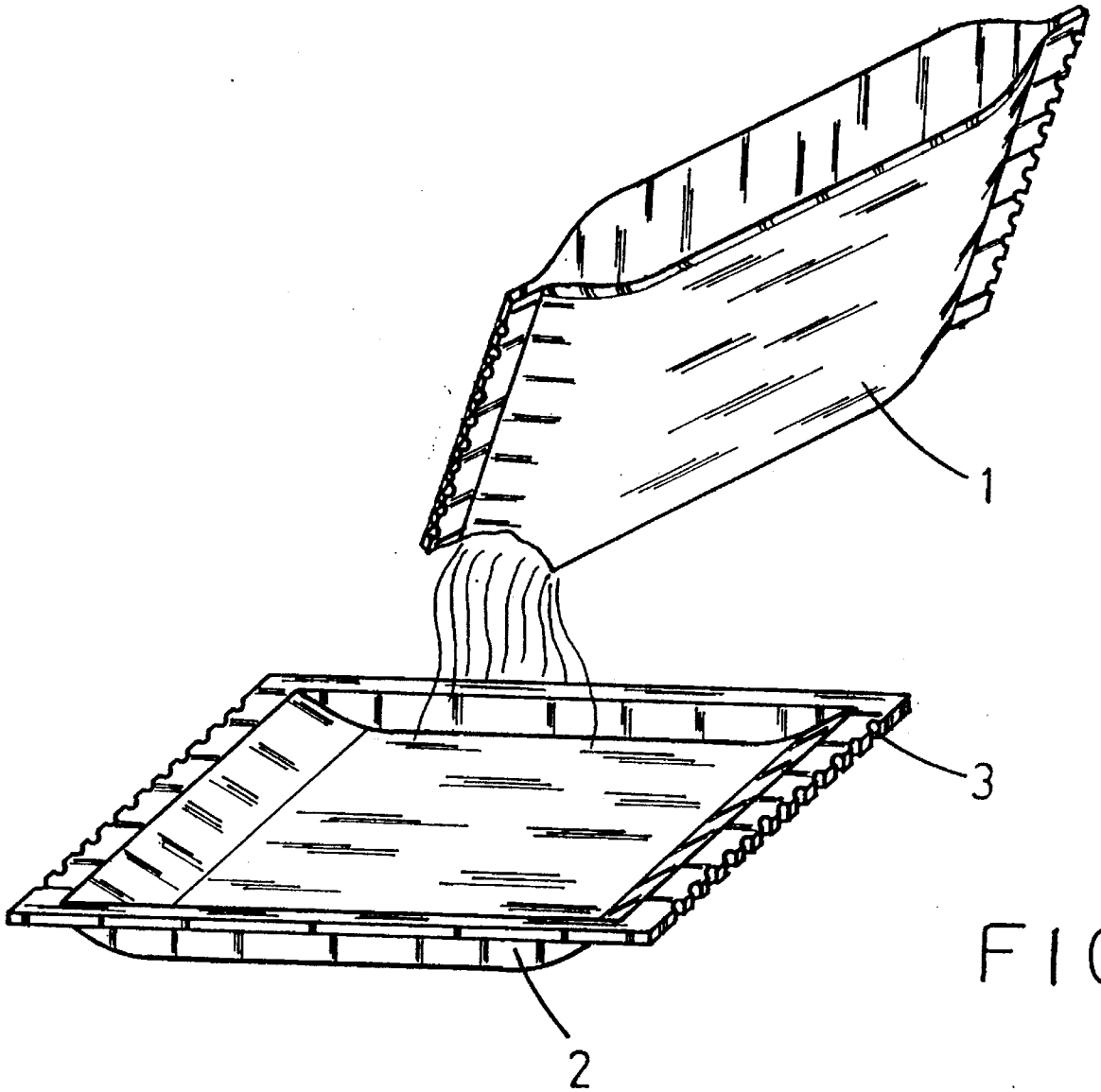
FIG. 4 is an isometric drawing of the invention herein illustrating utilization.

As indicated in FIG. 1 and FIG. 2, the invention herein mainly includes a container packet (1) and a box-like tray (2), of which the container packet (1) is thermally fused to the box-like tray (2) during the manufacturing process through a line of small holes (3) at the junction of the aforesaid thermal fusion; therefore, when the invention herein is utilized, it is only necessary to tear apart the laterally positioned line of small holes (3) to separate the box-like tray (2) from the container packet (1) and then the liquid sauce stored in the container packet (1) can be dispensed into the box-like tray (2), as indicated in FIG. 3, to provide extreme convenience in the utilization of the liquid sauce by the user.

Another advantage of the invention herein is that the box-like tray (2) is integrated to the container packet (1) and, therefore, can be expediently given to consumers, precluding the necessity of supplying a small plate or other accessory for the placement of the sauce and thereby effectively reducing cost. Furthermore, the invention here is suitable for packaging a wide range of different sauces and is easily modified in shape as well as method of attachment and, therefore, has a broad scope of application. However, any partial embellishments or modifications whatsoever based on the spirit of the invention herein shall be included within the patented claims of the invention herein.

What is claimed is:

1. A liquid sauce container packet and tray assembly consisting of:

a container packet, containing said liquid sauce, having two opposed sealed ends and;

a tray having a bottom, side walls and opposed flanges extending outwardly from respective opposing sidewalls;

wherein said packet is positioned within respective said tray and;

a portion of each of said opposed sealed ends being thermally fused to each of said respective opposed flanges of said tray, forming opposed thermally fused edges of said assembly;

and opposing lines of perforations, said perforations located respectively at the border between each of said thermally fused edges and the portions of said sealed ends and flanges which are not fused together;

so that, when the thermally fused edges are detached from the said assembly, said packet and said tray are separated;

thereby allowing the said contained sauce to be dispensed into said tray.

* * * * *